United States Patent [19]

Isao

[11] Patent Number: 4,881,685

[45] Date of Patent: Nov. 21, 1989

[54] PACKAGING CONTAINER

[76] Inventor: Sakai Isao, No. 2-11, 1-chome, Nishiogi-minami, Suginami-ku, Tokyo, Japan

[21] Appl. No.: 292,245

[22] Filed: Dec. 30, 1988

[30] Foreign Application Priority Data

Apr. 4, 1988 [JP] Japan ..... 63-44793[U]

[51] Int. Cl.[4] ..... B65D 5/20; B65D 5/46

[52] U.S. Cl. ..... 229/115; 229/162; 229/186; 229/117.18

[58] Field of Search ..... 229/108, 115, 162, 186, 229/52 B

[56] References Cited

U.S. PATENT DOCUMENTS

| | | | |
|---|---|---|---|
| 2,173,494 | 9/1939 | Rous | 229/108 |
| 2,192,307 | 3/1940 | Green | 229/162 |
| 2,302,677 | 11/1942 | Crane | 229/115 |
| 2,933,232 | 4/1960 | Bugnone | 229/52 B |
| 3,175,683 | 3/1965 | Billing | 229/115 |
| 3,250,454 | 5/1966 | Steiger | 229/115 |
| 3,730,418 | 5/1973 | Spencer | 229/115 |

FOREIGN PATENT DOCUMENTS

| | | | |
|---|---|---|---|
| 151145 | 4/1953 | Australia | 229/52 B |
| 758968 | 1/1934 | France | 229/115 |
| 1019065 | 2/1966 | United Kingdom | 229/115 |

*Primary Examiner*—Gary Elkins

*Attorney, Agent, or Firm*—Martin Smolowitz

[57] ABSTRACT

A packaging container formed by folding a blank into a pyramid shape, the blank comprising a rectangular bottom wall and four lateral walls which consist of front and rear walls and a pair of side walls. Each lateral wall has a maximum width between points where side edges of the adjacent lateral walls are joined together. The side walls each has a projection at the top end and a pair of laps at the side end portions. The blank is folded along each of the four sides of the bottom wall and boundaries of the lateral walls to raise the latter with respect to the bottom wall, while the side walls also are so folded that the laps face and abut the front and rear walls, respectively, with the projections being sandwiched between the top ends of the front and rear walls. The top ends and the projections are fastened together with a staple.

3 Claims, 4 Drawing Sheets

PACKAGING CONTAINER

BACKGROUND OF THE INVENTION

1. Field of the Invention

The present invention relates to a packaging container and, more particularly a packaging container which is especially suitable for vegetables such as bulbs of garlic and arrowhead, fruits, eggs, bulbs of flowers such as tulip, etc. and which can be easily manufactured and can pack the articles reliably.

2. Description of Prior Art

Conventionally, for sale in the market, garlic bulbs, for example, are packed in a mesh bag, or a few bulbs thereof are placed on a styrene resin tray and wrapped by polyethylene film. The above mesh bag usually contains a large number of garlic bulbs, say, 15 or 20 bulbs. The above resin tray containing a few bulbs is wrapped by polyethylene film which is in turn fastened by adhesive tape so that the film may not unfold, and thus the time-consuming wrapping work is required.

Garlic packed by the above conventional manner can be readily recognized by consumers what it is. However, a special kind of garlic such as odorless garlic can not be distinguished from the ordinary ones by the outside appearance, and therefore something descriptive of this should be provided. In the case of the above conventional packaging by polyethylene film, such an indication may be provided by a label placed inside the film or attached to its outer surface, with problems of the troublesome packaging step and of the difficulty for the consumers to read the indication.

On the other hand, when a paper box is used, the indication can be printed on the paper prior to assembly of the box so that the consumer can easily read it. There are however problems that the contents are invisible and that closure of the box requires several steps of work.

Accordingly, an object of the present invention is to provide a packaging container which can easily be manufactured and may pack articles reliably.

Another object of the invention is to provide a packaging container which may be provided with any desired indication in a readily visible manner while allowing consumers to ascertain contents without opening the container.

A further object of the invention is to provide a packaging container which may maintain its overall shape and does not collapse easily.

SUMMARY OF THE INVENTION

According to the invention, in a packaging container of the type which is formed by folding a blank comprising a rectangular bottom wall and four lateral walls each extending from one of the four sides of the bottom wall and by fastening the top ends of the lateral walls with a staple, the four sides of the bottom wall constitute respectively bases of the four lateral walls which consist of a front wall, a rear wall and a pair of opposite side walls. Boundaries between the adjacent lateral walls have equal length and intersect the respective bases at an angle of 45 degrees, and each lateral wall tapers toward the top end thereof with the maximum width being a distance between points where side edges of the adjacent lateral walls are joined together. Each of the side walls have a projection at the top end thereof, and a pair of laps formed outside of the two equal sides, respectively, of an isosceles triangle which is defined by linking the ends of said base and an apex of the side wall positioned below the projection. The blank is folded along the bases and the boundaries to raise the lateral walls with respect to the bottom wall, which the side walls also are folded along the equal sides in such a manner that the laps face and abut the front and rear walls, respectively, with the projections being sandwiched between the top ends of the front and rear walls. A staple fastens the projections and the top ends together.

The packaging container thus constituted has a pyramid-like shape with the four lateral walls being fastened together at the top ends, which means that only one stapling operation is required for assembly. The projections serve to fasten the side walls to the front and rear walls, while the laps reinforces the joint portions of lateral walls to resist collapse. The external surfaces of lateral walls have a dimension sufficient to permit any desired indications such as trademarks, features, virtues and other advertisements of contents.

Other structures, features and advantages of the invention will be apparent from the following description of preferred embodiments thereof when taken in conjunction with the accompanying drawings.

DESCRIPTION OF THE PREFERRED EMBODIMENTS

Figure 4:
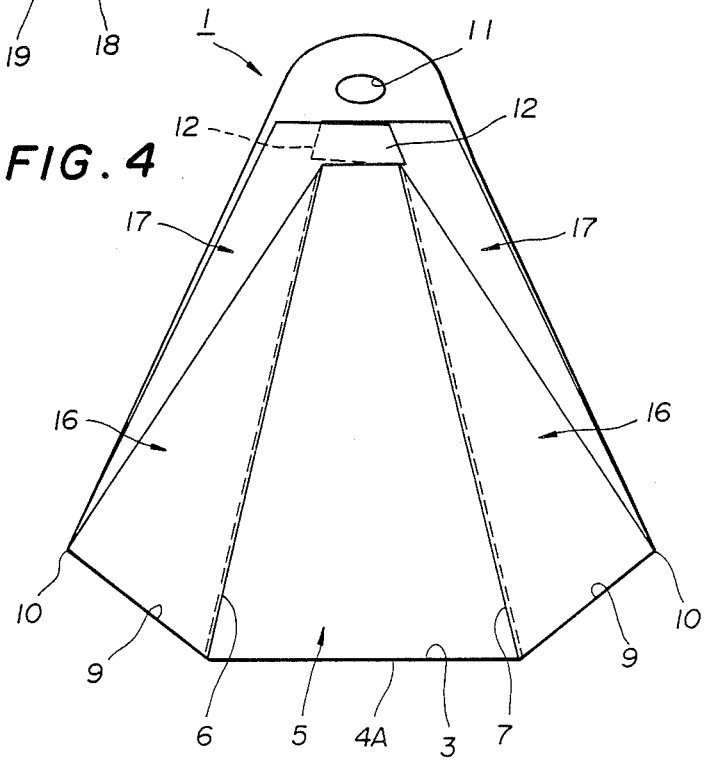
FIG. 4 is a front view thereof with a front wall being removed therefrom.
Figure 5:
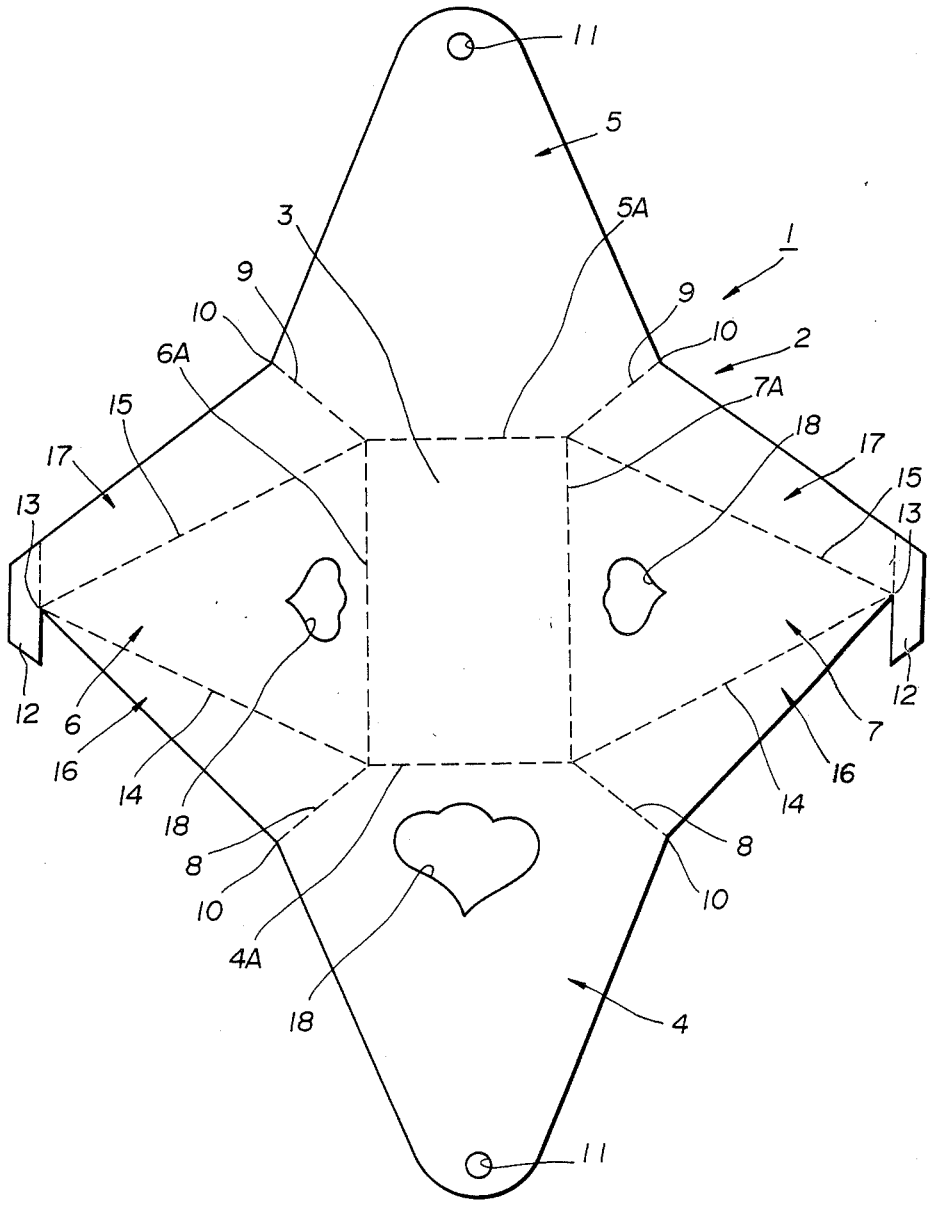
FIG. 5 is a developed plan view thereof.

Referring to FIGS. 1 to 5 of the drawings, there is illustrated a packaging container 1 according to one embodiment of the invention which comprises, as best shown in FIG. 5, a bottom wall 3 disposed at the center of a blank 2, and four lateral walls 4, 5, 6, 7 integral with and disposed around the bottom wall 3. Material of the blank 2 may be selected from paper, synthetic paper, plastic sheet, unwoven cloth, etc. so that the blank 2 should have excellent printability and firmness of texture.

The lateral walls consists of a front wall 4 which is to face purchasers when the container 1 is displayed in a store, a rear wall 5 disposed opposite the front wall 4, and left and right side walls 6 and 7 disposed respectively to the left and right of the front wall. The bases 4A, 5A, 6A, 7A of the lateral walls border respectively on the four sides of the bottom wall 3. The lower opposite sides of each lateral wall are joined to the adjacent lateral walls with their boundaries 8, 8, 9, 9 intersecting the respective bases 4A, 5A, 6A, 7A at an angle of 45 degrees. Each of these boundaries 8, 8, 9, 9 extends to a point 10 where the side edges of the adjacent lateral walls are joined together, and all the boundaries are of the same length.

Both the front wall 4 and the rear wall 5 taper toward respective top ends, with the largest width being a distance between the points 10-10. A height from the bases 4A or 5A to the top end exceeds a height of the left and right side walls 6, 7 to provide an end marginal portion in which is formed a hole 11. These holes in the front and rear walls are adapted to receive a hook for hanging the container 1 in a retail shop, supermarket or the like.

The left and right side walls 6, 7 taper toward their respective top ends, their height from the bases 6A, 7A to the top ends not exceeding the distance from the bases 4A, 5A to the holes 11 of the front and rear walls. A bar-shaped projection 12 is provided at the top end of each side wall and extends toward the front wall 4 in parallel with the base 6A or 7A, defining a notch in cooperation with the side edge of the side wall. The inner end of the notch constitutes an apex 13 of isosceles triangle which is formed by linking the apex 13 and both ends of the base 6A or 7A, the two equal sides of triangle providing fold lines 14 and 15. Provided outside the triangle are marginal portions 16 and 17 which become laps when the blank 2 is folded into the container 1, as hereinafter described. The marginal portion 16, positioned adjacent the front wall 4, has a triangular shape defined by the boundary 8, fold line 14 and the side edge which extends between the apex 13 and joint point 10. On the other hand, the marginal portion 17 adjacent the rear wall 5 is trapezoidal and confined by the boundary 9, fold line 15, lower side of projection 12 and the side edge which extends between the projection lateral edge and joint point 10. The marginal portion 17 is trapezoid because of the provision of projection 12, while the margin 16 is triangular so that these portions 16 and 17 can be readily folded along the lines 14 and 15. It is to be noted, however, that they are not limited to the above particular shapes.

The blank 2 is to be folded along the bases 4A, 5A, 6A and 7A and the boundaries 8 and 9 as well as along the lines 14 and 15. Preferably, perforations or the like are provided on these creases in order to facilitate the folding operation of the blank 2. Reference numeral 18 indicates openings through which contents can be seen, but it may be omitted when the blank 2 is formed of transparent synthetic resin material. Illustrated at 19 is a description or indication for the contents.

The blank 2 is folded into the container 1 in the following manner.

First the bottom wall 3 is placed on a horizontal surface, and the top end of the rear wall 5 is raised such that the blank is folded along the base 5A with the base 5A forming a groove in plan view. The top ends of the side walls 6 and 7 are then raised such that the blank is folded along the bases 6A, 7A and the boundaries 9 with these forming grooves, while folding the blank also along the lines 15 so that the marginal portions 17 face the rear wall 5 with the lines 15 forming ridges. The term "groove" and "ridge" herein are used when viewed in plan. As the rear wall 5 and side walls 6 and 7 are raised to upright positions, the marginal portions or laps 17 approach the rear wall 5.

Next, the front wall 4 is raised to fold along the base 4A and the boundaries 8 with these forming grooves, while folding the side walls 6 and 7 along the lines 14 with these lines forming ridges. As the front wall 4 is raised to upright positions, it approaches the marginal portions or laps 16.

Figure 1:
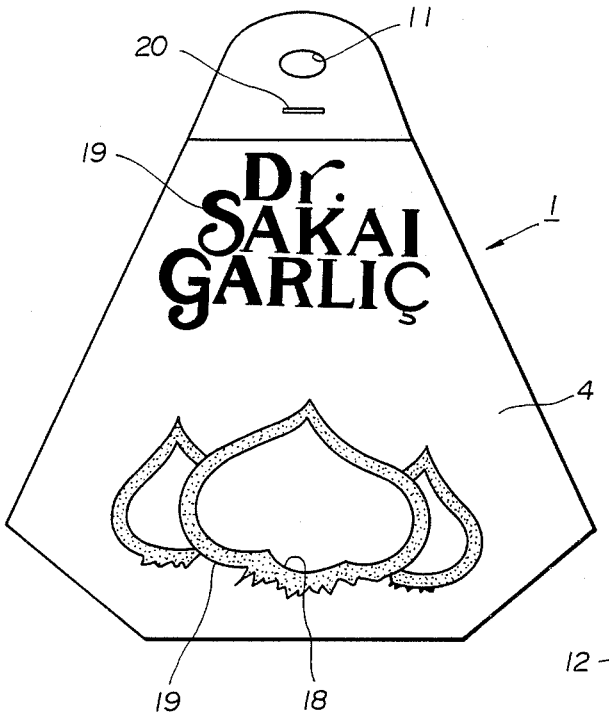
FIG. 1 is a front elevational view illustrating a packaging container according to a preferred embodiment of the invention.
Figure 2:
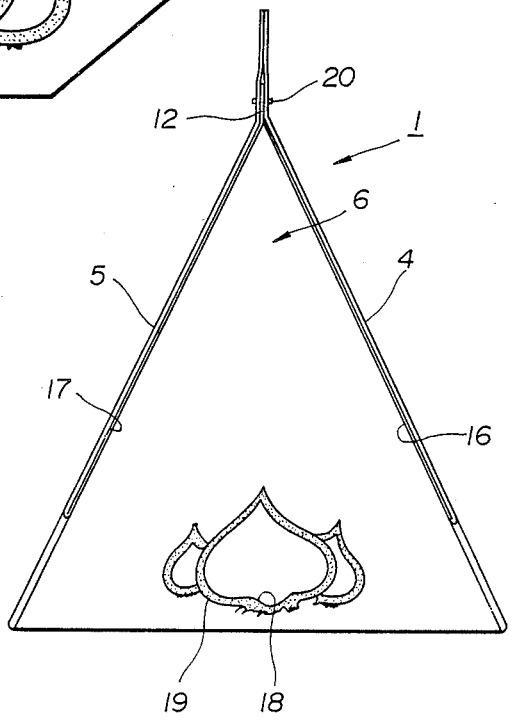
FIG. 2 is an elevational view thereof as seen from left-hand side of FIG. 1.
Figure 3:
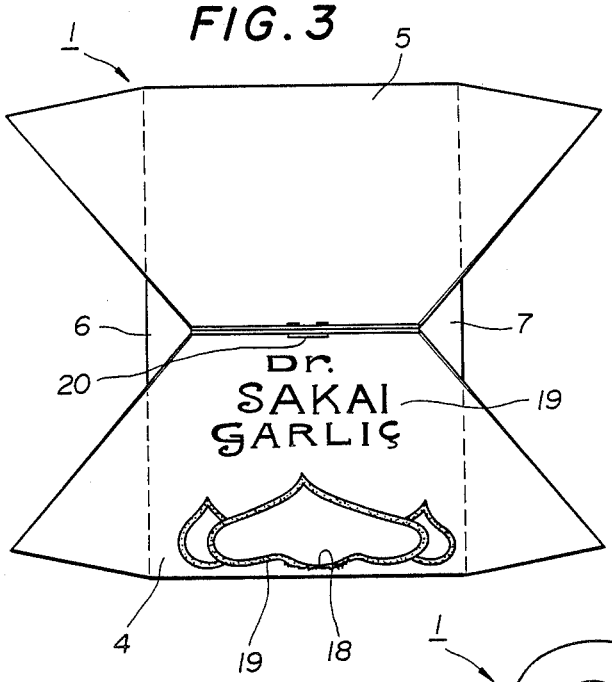
FIG. 3 is a plan view thereof.

The top ends of the walls 4, 5, 6, 7 are caused to approach one another until the front wall 4 and the rear wall 5 come into close contact with the laps 16 and the laps 17 respectively, and in such a manner that both projections 12, 12 overlap each other between the top end portions of the front wall 4 and the rear wall 5 (see FIG. 4). Thereafter, the top end portions and the projections 12 are fastened together by a staple 20 to complete the packaging container 1 of generally pyramid-shape, as shown in FIGS. 1 and 2.

Contents, such as garlic for example, are accommodated within the container 1 prior to the fastening by staple 20 and they can be seen through the openings 18. The external surfaces of the container 1 is large enough to permit desired descriptions or indications 19 of a trademark, features, merits etc. of the contents. The container 1 will not collapse easily because of the pyramid-like shape, and it is durable since the laps 16 and 17 serve as reinforcements. The packaging efficiency is excellent since the stapling is required at only one point. If desired, the laps 16 and 17 may be fastened to the front and rear walls 4 and 5, respectively, for further increasing the strength.

Figure 6:
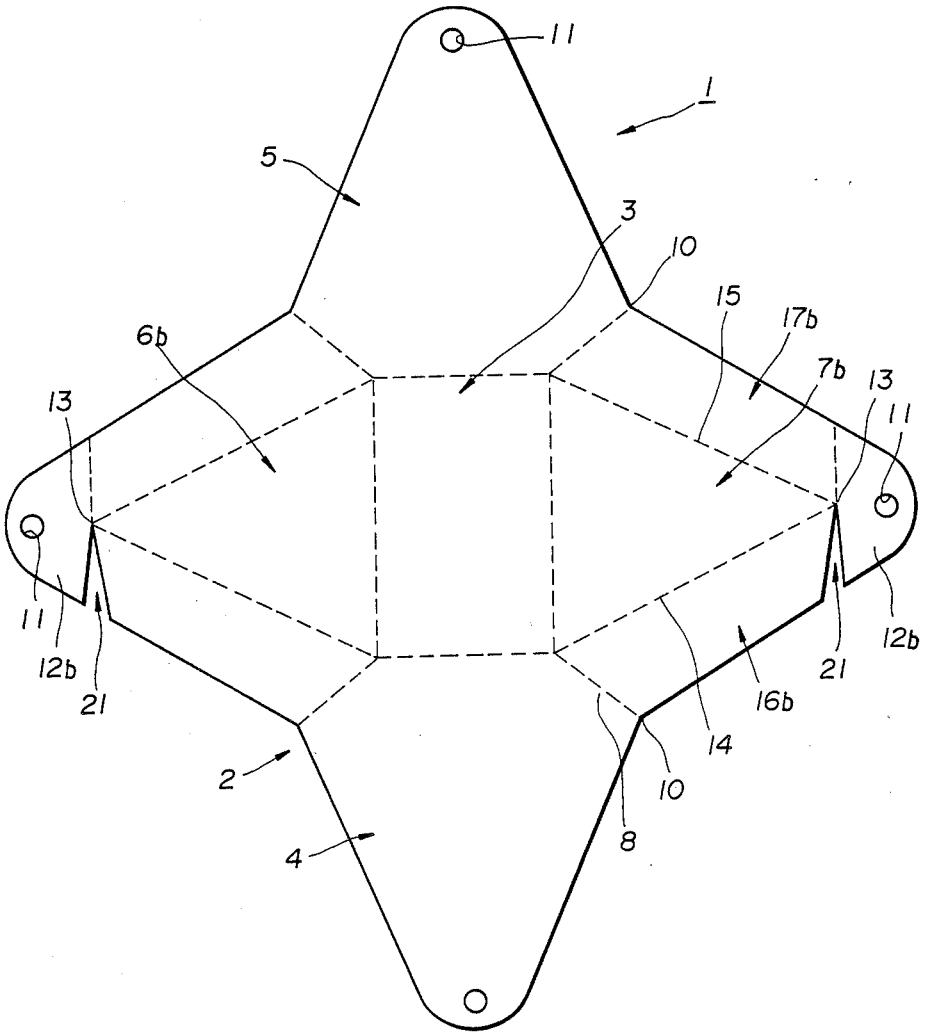
FIG. 6 is a developed plan view of a packaging container according to another embodiment of the invention.

FIG. 6 shows another embodiment in which a shape of the projection 12 is modified. Since the whole structure is generally the same as that of FIG. 5, the same reference numerals are used with addition of "b" to indicate corresponding parts and descriptions of the same components are omitted.

In this embodiment, side walls **6*b* and 7*b* have a height substantially equal to the front and rear walls 4 and 5 with rounded top ends forming projections 12*b* having holes 11. Marginal portions 16*b* and 17*b* are both trapezoidal, and a triangular notch 21 is formed in the marginal portion 16*b* to extend from the apex 13**. These arrangements result in the top end portions of four lateral walls overlapping each other, thereby increasing strength of the container top end.

As it could be understood from the foregoing descriptions, the packaging container according to the invention has the following advantages:

(1) Since the container has the pyramid-like shape, and at its top the projections of the left and right side walls are sandwiched between the front and the rear walls, package can be completed simply by fastening the top ends of four lateral walls with only one staple.

(2) The laps extending upwardly from the four corners of the bottom wall significantly reinforce the container and resist a pressure which would otherwise collapse the container.

(3) The external surfaces of the container have dimensions sufficient to enable manufacturers to print thereon any desired indications or descriptions such as trademarks, features, virtues and other advertisements.

(4) The blank may be formed of inexpensive materials which, in cooperation with the easy assembly of the container, can minimize the cost of packaging container.

Although the present invention has been described with reference to the preferred embodiments thereof, many modifications and alterations may be made within the spirit of the invention.

What is claimed is:

1. A packaging container formed by folding a blank comprising a rectangular bottom wall and four lateral walls each extending from one of the four sides of said bottom wall and by fastening the top ends of said lateral walls with a staple, wherein the four sides of said bottom wall constitute respectively bases of said four lateral walls which consist of a front wall, a rear wall and a pair of opposite side walls; boundaries between adjacent said lateral walls have equal length and intersect respective said bases at an angle of 45 degrees; each said lateral wall tapers toward the top end thereof with the maximum width being a distance between points where the side edges of adjacent said lateral walls are joined together; each of said side walls has a projection at the top end thereof and a pair of laps formed outside of two equal sides, respectively, of an isosceles triangle which is defined by linking the ends of said base and an apex of said side wall positioned below said projection; and said blank is folded along said bases and said boundaries to raise said lateral walls with respect to said bottom wall, said side walls being folded along said equal sides in such a manner that said laps face and abut said front and rear walls, respectively, with said projections being sandwiched between the top ends of said front and rear walls, whereby a staple fastens said projections and said top ends together.

2. A packaging container as claimed in claim 1, wherein the top ends of said front and rear walls are provided with holes for hanging.

3. A packaging container as claimed in claim 1, wherein said lateral walls are provided with openings through which contents are to be recognized.

* * * * *